United States Patent [19]

Boesch

[11] 4,083,734

[45] Apr. 11, 1978

[54] NICKEL BASE ALLOY

[75] Inventor: William J. Boesch, Utica, N.Y.

[73] Assignee: Special Metals Corporation, New Hartford, N.Y.

[21] Appl. No.: 691,161

[22] Filed: Jun. 9, 1976

Related U.S. Application Data

[63] Continuation-in-part of Ser. No. 597,853, Jul. 18, 1975, abandoned.

[51] Int. Cl.[2] ..... C22C 19/05

[52] U.S. Cl. ..... 148/32.5; 75/171; 148/162

[58] Field of Search ..... 75/171, 170; 148/32, 148/32.5, 162

[56] References Cited

FOREIGN PATENT DOCUMENTS 921,733 2/1973 Canada ..... 75/171

*Primary Examiner*—R. Dean

*Attorney, Agent, or Firm*—Vincent G. Gioia; Robert F. Dropkin

[57] ABSTRACT

A gamma prime strengthened nickel base alloy having a 1650° F impact strength of at least 6 ft.-lbs. after 35,000 hours exposure at 1600° F. The alloy consists essentially of, by weight, from 12.0 to 20.0% chromium, from 4.75 to 7.0% titanium, from 1.3 to 3.0% aluminum, from 13.0 to 19.0% cobalt, from 2.0 to 3.5% molybdenum, from 0.5 to 2.5% tungsten, from 0.005 to 0.03% boron, from 0.005 to 0.045% carbon, up to 0.75% manganese, up to 0.08% zirconium, up to 0.5% iron, up to 0.2% of rare earth elements that will not lower the incipient melting temperature below the solvus temperature of the gamma prime present in the alloy, up to 0.02% of elements from the group consisting of magnesium, calcium, strontium and barium, balance essentially nickel.

4 Claims, 2 Drawing Figures

NICKEL BASE ALLOY

Figure 1:
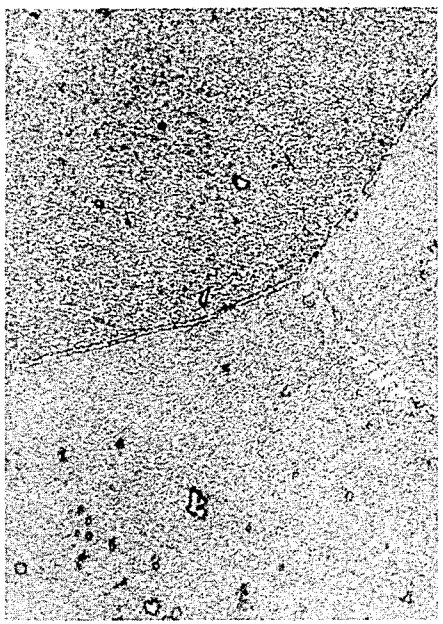

This application is a continuation-in-part of now abandoned copending application Ser. No. 597,853, filed July 18, 1975.

The present invention relates to a wrought gamma prime strengthened nickel base alloy.

U.S. Pat. No. 3,667,938 claims an alloy consisting essentially of, by weight, from 12.0 to 20.0% chromium, from 5 to 7% titanium, from 1.3 to 3.0% aluminum, from 13.0 to 19.0% cobalt, from 2.0 to 3.5% molybdenum, from 0.5 to 2.5% tungsten, from 0.005% to 0.03% boron, from 0.05 to 0.15% carbon, balance essentially nickel. Although this alloy has good hot corrosion resistance, strength, creep resistance, phase stability, and most importantly, stress rupture life; its hot impact strength deteriorates at an undesirable rate after long time service at elevated temperatures. A need therefore exists for an alloy with properties similar to that exhibited by the alloy of U.S. Pat. No. 3,667,938, but yet one with improved hot impact strength characteristics. The present invention provides just such an alloy.

Through the present invention, it has been determined that the hot impact strength characteristics of the alloy described in U.S. Pat. No. 3,667,938 could be materially improved if the carbon content thereof was lowered from a minimum value of 0.05 to a maximum value of 0.045%. The alloy of U.S. Pat. No. 3,667,938 contained at least 0.05% carbon as it was felt that the alloys' stress rupture properties were dependent upon this minimum amount. In fact, during the prosecution of said patent, the parent application was refiled to set forth a chemistry which better reflected the invention. The refiling, in part, encompassed a change in disclosed carbon of from 0.02 to 0.05%. Now, through the present invention, it has been proven that the alloys' hot impact strength can be improved by lowering the carbon content, and that such improvement does not have to be at the expense of stress rupture properties. Unlike the foreign counterparts of said referred to parent application, the subject application teaches the benefit of low carbon contents, and shows said benefit through specific examples. As for the foreign counterparts they are identifiable as follows: Japanese Patent No. 46-21820; Canadian Patent No. 921733; French Patent No. 1,596,607; and Swedish Patent No. 342,260.

Another nickel base alloy is disclosed in U.S. Pat. No. 3,385,698. Although this alloy can have a low carbon content, it is considerably different from that of U.S. Pat. No. 3,667,938 and the alloy of the present invention. Among other differences, the maximum titanium content for the alloy of U.S. Pat. No. 3,385,698 is below the minimum for the alloy of the present invention.

A third nickel base alloy which at first glance might appear similar to the present invention is disclosed in U.S. Pat. No. 3,869,284, now Re. 28,681. In reality such is not the case. Among other differences, the alloy described therein contains considerably more boron than does the alloy of the present invention. Such levels of boron would decrease the workability of the alloy of the present invention.

It is accordingly an object of the present invention to provide a wrought gamma prime strengthened nickel base alloy having a 1650° F impact strength of at least 6 ft.-lbs. after 35,000 hours exposure at 1600° F.

Figure 2:
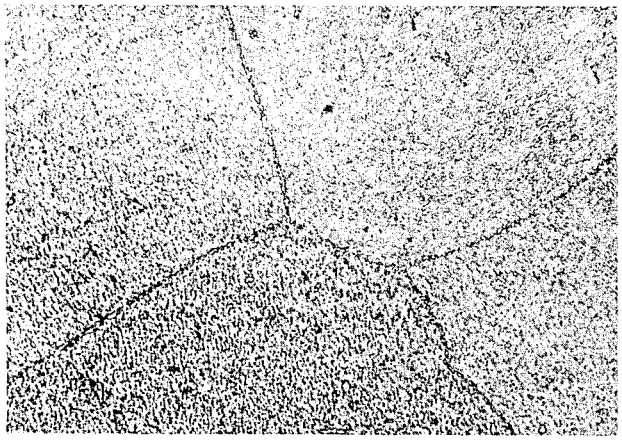

The foregoing and other objects of the invention will be best understood from the following description, reference being had to the accompanying photomicrographs wherein:

FIG. 1 is a photomicrograph at 600× of a nickel base alloy having a carbon content of 0.05%; and FIG. 2 is a photomicrograph at 600× of a nickel base alloy having a carbon content of 0.02%.

The present invention provides a wrought gamma prime strengthened nickel base alloy having a 1650° F impact strength of at least 6 ft.-lbs. after 35,000 hours exposure at 1600° F; and, moreover, one which is additionally characterized by good hot corrosion resistance, strength, creep resistance, phase stability and stress rupture life. The alloy consists essentially of, by weight, from 12.0 to 20.0% chromium, from 4.75 to 7.0% titanium, from 1.3 to 3.0% aluminum, from 13 to 19.0% cobalt, from 2.0 to 3.5% molybdenum, from 0.5 to 2.5% tungsten, from 0.005 to 0.03% boron, from 0.005 to 0.045% carbon, up to 0.75% manganese, up to 0.08% zirconium, up to 0.5% iron, up to 0.2% of rare earth elements that will not lower the incipient melting temperature below the solvus temperature of the gamma prime present in the alloy, up to 0.02% of element from the group consisting of magnesium, calcium, strontium and barium, balance essentially nickel. Exemplary rare earth elements are cerium and lanthanum.

In addition to the above, a titanium to aluminum ratio of from 1.75:1 to 3.5:1 is imposed upon the subject alloy to help insure the formation of spheroidal gamma prime. Gamma prime which is believed to have the general composition $M_3$ (Al, Ti) gives the alloy its strength. Of the various forms of gamma prime, spheroidal gamma prime is preferred. As used herein the M portion of the gamma prime composition is regarded as consisting mainly of nickel with some substitution of chromium and molybdenum in the approximate proportions, 95 nickel, 3 chromium and 2 molybdenum. Respective minimum aluminum and titanium contents of 1.3% and 4.75% are required to insure adequate strength. For the same reason the total aluminum and titanium content must be at least 6.5%. The total aluminum and titanium content should not, however, exceed 9.0% as too much can hinder workability.

In part, the subject invention is based upon the following observations and discoveries:

1. that MC carbides present in the alloy of heretofore referred to U.S. Pat. No. 3,667,938 transform to $M_{23}C_6$ carbides after being in service at elevated temperatures for a prolonged period of time;
2. that $M_{23}C_6$ carbides are responsible for a severe deterioration of said alloy's hot impact strength; and
3. that the hot impact strength of said alloy can be substantially improved by lowering the carbon content of said alloy to a maximum level of 0.045%, and to a preferred maximum level of 0.04%.

Prior to the present invention, those skilled in the art thought that the alloy of U.S. Pat. No. 3,667,938 required a carbon content of at least 0.05%, to insure adequate stress rupture properties. Through the present invention it has been discovered that the alloy's hot impact strength can be substantially increased if its carbon content is lowered to a maximum level of 0.045%; and that such improvement does not have to be at the expense of stress rupture properties. By keeping carbon contents below 0.045% less MC forms, and consequently less $M_{23}C_6$. MC carbides are believed to be primarily TiC with some molybdenum. On the other hand, $M_{23}C_6$ carbides are believed to be basically $Cr_{23}C_6$ with some molybdenum. The molybdenum level of $M_{23}C_6$ carbides is less than that of MC carbides. Accompanying the maximum carbon limits are respective minimum and minimum preferred levels of 0.005 and 0.01%. The minimum levels insure adequate deoxidation of the alloy during the melting period.

To provide the alloy with even better stress rupture properties, additions of small amounts of zirconium and/or rare earth metals can be made. Rare earth additions are generally in amounts of from 0.012 to 0.024%. Zirconium additions are generally in amounts of from 0.01 to 0.08%. In most instances zirconium levels do not exceed 0.06%. Preferred zirconium levels are from 0.02 to 0.06%.

The following examples are illustrative of several aspects of the invention.

EXAMPLE I

Specimens of a wrought nickel base alloy having a chemistry within that of heretofore referred to United States Patent No. 3,667,938 were heat treated as follows:

2150° F — 4 hours — air cool
1975° F — 4 hours — air cool
1550° F — 24 hours — air cool
1400° F — 16 hours — air cool The specimens were subsequently exposed to a temperature of 1600° F for various time periods, and tested for impact strength at 1650° F. The results of the tests appear hereinbelow in Table I.

TABLE I.

| Hours at 1600° F | 1650° F Impact Strength (Foot Pounds) |
|---|---|
| 0 | 15 |
| 7,500 | 2 |
| 10,000 | 2 |
| 15,000 | 2 |
| 20,000 | 2 |

From Table I it is clear that the tested alloy does not have a 1650° F impact strength of at least 6 ft.-lbs. after 35,000 hours exposure at 1600° F. In fact it does not have such an impact strength after 7,500 hours exposure. On the other hand, the alloy of this invention has an impact strength of at least 6 ft.-lbs. after 35,000 hours exposure at 1600° F.

A review of the chemistry of the tested alloy reveals a carbon content of 0.07%. To the contrary, the alloy of this invention has a maximum carbon content of 0.045%. The specific chemistry of the tested alloy appears hereinbelow in Table II.

TABLE II.

| Composition (wt. %) | | | | | | | | |
|---|---|---|---|---|---|---|---|---|
| C | Cr | Ti | Al | Co | Mo | W | B | Ni |
| 0.07 | 18.1 | 5.10 | 2.49 | 15.2 | 3.10 | 1.47 | 0.021 | Bal. |

EXAMPLE II

Additional specimens of wrought nickel base alloys from several heats were heat treated as was the alloy in Example I, and subsequently exposed to a temperature of 1650° F for various periods of time. The chemistry of the heats appears hereinbelow in Table III.

TABLE III.

| | Composition (wt. %) | | | | | | | | |
|---|---|---|---|---|---|---|---|---|---|
| Heat | C | Cr | Ti | Al | Co | Mo | W | B | Ni |
| A | 0.048 | 17.9 | 4.94 | 2.59 | 14.9 | 3.05 | 1.48 | 0.018 | Bal. |
| B | 0.05 | 17.9 | 4.87 | 2.58 | 15.0 | 3.10 | 1.40 | 0.021 | Bal. |
| C | 0.02 | 18.0 | 5.04 | 2.58 | 14.9 | 3.10 | 1.39 | 0.021 | Bal. |
| D | 0.03 | 17.8 | 4.99 | 2.48 | 15.1 | 3.10 | 1.38 | 0.022 | Bal. |
| E | 0.04 | 17.9 | 4.87 | 2.58 | 14.9 | 3.10 | 1.39 | 0.019 | Bal. |

After exposure, the specimens were tested for impact strength at 1650° F. The results of the tests appear hereinbelow in Table IV.

TABLE IV.

| | 1650 ° F Impact Strength (Foot Pounds) | | | | | | | | |
|---|---|---|---|---|---|---|---|---|---|
| | Hours at 1650° F | | | | | | | | |
| Heat | 0 | 100 | 200 | 250 | 500 | 750 | 1,000 | 1,500 | 3,000 |
| A | 20,21 | 10.0 | — | 8.5 | 6.0 | 6.0 | 7.0 | 9, 10 | — |
| B | 26.0 | — | 12.0 | — | 9.0 | — | 16.0 | 7.5 | 7.0 |
| C | 22.0 | — | 17.0 | — | 16.0 | — | 22.0 | 14.0 | 11.0 |
| D | 20.0 | — | 14.0 | — | 14.0 | — | 17.0 | 15.5 | 14.5 |
| E | 23.0 | — | 16.0 | — | 12.5 | — | 16.0 | 16.5 | 17.1 |

The data in Table IV clearly indicates that the improved hot-impact strength of the present invention is attributable to the alloy's low carbon content. Each of the heats have basically the same chemistry with the exception of carbon, yet the hot-impact strengths of specimens from heats C, D and E with low carbon contents are superior to those of specimens from heats A and B, after exposure to elevated temperatures. The carbon contents of heats C, D, and E are all below 0.045 whereas those of heats A and B are respectively 0.048 and 0.05%.

Although the data in Table IV is given for only 3,000 hours, it is believed to be applicable for predicting impact strengths after 35,000 hours exposure. Log (time) vs. log (impact strength) plots indicate that data obtained after 3,000 hours can be used to reflect impact strengths after 35,000 hours.

Photomicrographs of specimens from heats B and C respectively appear in FIGS. 1 and 2. The photomicrographs taken at 600× are of specimens which received respective exposures of 82.6 and 88.0 hours at 1800° F. From the photomicrograph, it is clear that the specimen from heat B (FIG. 1) has a greater quantity of detrimental $M_{23}C_6$ carbide, than does the specimen from heat C (FIG. 2). Also observable therefrom is that the specimen from heat B has more MC carbide than does the specimen from heat C; and as noted hereinabove, it is the MC carbide which transforms to $M_{23}C_6$ carbide on continued exposure at elevated temperatures.

EXAMPLE III

Additional specimens of wrought nickel base alloys were heat treated as were the alloys of Examples I and II, and subsequently tested for 1800° F stress rupture properties. The specimens were practically identical with the exception of their zirconium content. Their chemistry appears hereinbelow in Table V.

TABLE V.

| | Composition (wt. %) | | | | | | | | | |
|---|---|---|---|---|---|---|---|---|---|---|
| Heat | C | Cr | Ti | Al | Co | Mo | W | B | Zr | Ni |
| F | 0.05 | 17.9 | 4.94 | 2.59 | 14.9 | 3.05 | 1.48 | 0.02 | — | Bal. |
| G | 0.05 | 17.9 | 5.01 | 2.59 | 14.8 | 3.10 | 1.48 | 0.02 | 0.03 | Bal. |

TABLE V.-continued

| Heat | C | Cr | Ti | Al | Co | Mo | W | B | Zr | Ni |
|---|---|---|---|---|---|---|---|---|---|---|
| | | | | | Composition (wt. %) | | | | | |
| H | 0.05 | 18.0 | 5.00 | 2.58 | 14.9 | 3.10 | 1.48 | 0.02 | 0.06 | Bal. |

The 1800° F stress rupture properties for the specimens appears hereinbelow in Table VI.

TABLE VI.

1800° F/16 ksi Smooth Bar Stress Rupture Properties

| Heat | Life (hrs) | Elongation (%) | Reduction In Area (%) |
|---|---|---|---|
| F | 120.3 | 9.8 | 15.8 |
| G | 149.3 | 12.7 | 20.3 |
| H | 155.8 | 19.3 | 29.5 |

The data in Table VI indicates that zirconium additions would enhance the 1800° F stress-rupture properties of alloys within the subject invention. Heats F, G and H differ therefrom only in their carbon content.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. A gamma prime strengthened nickel base alloy consisting essentially of, by weight, from 12.0 to 20.0% chromium, from 4.75 to 7.0% titanium, from 1.3 to 3.0% aluminum, from 13.0 to 19.0% cobalt, from 2.0 to 3.5% molybdenum, from 0.5 to 2.5% tungsten, from 0.005 to 0.03% boron, from 0.005 to 0.045% carbon, up to 0.75% manganese, (up) from 0.01 to 0.08% zirconium, up to 0.5% iron, up to 0.2% of rare earth elements that will not lower the incipient melting temperature below the solvus temperature of the gamma prime present in the alloy, up to 0.02% of elements from the group consisting of magnesium, calcium, strontium and barium, balance essentially nickel; said titanium plus said aluminum content being from 6.5 to 9.0; said titanium and aluminum being present in a titanium to aluminum ratio of from 1.75:1 to 3.5:1; said alloy being substantially free of deleterious acicular, sigma and mu phases; said alloy having a 1650° F impact strength of at least 6 ft.-lbs. after 35,000 hours exposure at 1600° F; said alloy forming substantially fewer $M_{23}C_6$ carbides than similar alloys of higher carbon content after long term service at elevated temperatures; said gamma prime being characterized as gamma prime which is substantially spheroidal.

2. A nickel base alloy according to claim 1, having from 0.01 to 0.04% carbon.

3. A nickel base alloy according to claim 1, having from 0.02 to 0.06% zirconium.

4. A gamma prime strengthened nickel base alloy consisting essentially of, by weight, from 12.0 to 20.0% chromium, from 4.75 to 7.0% titanium, from 1.3 to 3.0% aluminum, from 13.0 to 19.0% cobalt, from 2.0 to 3.5% molybdenum from 0.5 to 2.5% tungsten, from 0.005 to 0.03% boron, from 0.01 to 0.04% carbon, up to 0.75% manganese, (up) from 0.02 to 0.06% zirconium, up to 0.5% iron, up to 0.2% of rare earth elements that will now lower the incipient melting temperature below the solvus temperature of the gamma prime present in the alloy, up to 0.02% of elements from the group consisting of magnesium, calcium, strontium and barium, balance essentially nickel; said titanium plus said aluminum content being from 6.5 to 9.0%; said titanium and aluminum being present in a titanium to aluminum ratio of from 1.75:1 to 3.5:1; said alloy being substantially free of deleterious acicular, sigma and mu phases; said gamma prime being characterized as gamma prime which is substantially spheroidal.

* * * * *